US011125539B2

(12) United States Patent
Hague et al.

(10) Patent No.: US 11,125,539 B2
(45) **Date of Patent: *Sep. 21, 2021**

(54) RUGGEDIZED HOLDER

(71) Applicant: Evolve Range Solutions, Inc., New Castle, IN (US)

(72) Inventors: Douglas Lee Hague, Covington, OH (US); William Charles Flock, Tipp City, OH (US)

(73) Assignee: EVOLVE RANGE SOLUTIONS, INC., New Castle, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/860,246

(22) Filed: Apr. 28, 2020

(65) Prior Publication Data

US 2020/0256651 A1 Aug. 13, 2020

Related U.S. Application Data

(63) Continuation of application No. 16/361,060, filed on Mar. 21, 2019, now Pat. No. 10,677,570.

(Continued)

(51) Int. Cl.

| | |
|---|---|
| ***F41J 1/10*** | (2006.01) |
| ***F41J 7/00*** | (2006.01) |
| ***F41J 7/02*** | (2006.01) |

(52) U.S. Cl.

CPC .. *F41J 1/10* (2013.01); *F41J 7/00* (2013.01); *F41J 7/02* (2013.01)

(58) Field of Classification Search

CPC ..... F41J 1/10; F41J 7/00; F41J 7/02; F41J 11/02; F41J 5/10

See application file for complete search history.

(56) References Cited

U.S. PATENT DOCUMENTS 1,981,293 A * 11/1934 Varrelman ..... F41J 1/10 273/404
2,034,839 A * 3/1936 Sheffield ..... F41J 7/00 273/382

(Continued)

FOREIGN PATENT DOCUMENTS

DE 8621651 U1 6/1988
DE 29915933 U1 9/2000

(Continued)

OTHER PUBLICATIONS

U.S. Pat. No. 840,610; Easdale; issued Jan. 8, 1907.

(Continued)

*Primary Examiner* — Jeffrey S Vanderveen

(74) *Attorney, Agent, or Firm* — Thomas E. Lees, LLC

(57) ABSTRACT

A ruggedized holder has a base unit that accepts a roll of target media. The base unit includes a first side plate and a second side plate that opposes the first side plate. Moreover, a lower deflector plate having a front facing surface extends between the first side plate and the second side plate. Also, the base unit includes an upper deflector plate that extends between the first side plate and the second side plate above the lower deflector plate. The first side plate, the second side plate, the lower deflector plate and the upper deflector plate define an enclosure that protects the roll of target media. In addition, a stand can couple to the base unit.

20 Claims, 11 Drawing Sheets

Related U.S. Application Data

(60) Provisional application No. 62/646,065, filed on Mar. 21, 2018.

(56) References Cited

U.S. PATENT DOCUMENTS

| | | | | | |
|---|---|---|---|---|---|
| 2,048,155 | A * | 7/1936 | Armantrout | F41J 7/00 | 273/407 |
| 2,466,686 | A * | 4/1949 | Connelly | F41J 1/10 | 226/43 |
| 3,495,829 | A * | 2/1970 | Booth | F41J 13/02 | 273/371 |
| 3,519,272 | A * | 7/1970 | Vogelaere | F41J 1/10 | 273/404 |
| D228,186 | S * | 8/1973 | Wortley, Jr. | D22/113 | |
| 3,914,879 | A * | 10/1975 | Taylor, III | F41J 7/06 | 434/19 |
| D241,246 | S * | 8/1976 | De Vogelaere | D22/113 | |
| 4,151,996 | A * | 5/1979 | Lee | F41J 13/02 | 206/315.1 |
| 4,317,572 | A * | 3/1982 | Iseli | F41J 1/10 | 273/406 |
| 4,540,182 | A * | 9/1985 | Clement | F41J 7/04 | 273/391 |
| 4,548,414 | A * | 10/1985 | Denis | F41J 9/02 | 273/359 |
| 4,583,744 | A * | 4/1986 | Tolliver | F41J 13/02 | 273/378 |
| D284,422 | S * | 7/1986 | Pomaville | D22/199 | |
| D287,530 | S * | 12/1986 | Magnuson | D22/113 | |
| D300,162 | S * | 3/1989 | Ravalli | D22/113 | |
| 4,813,684 | A * | 3/1989 | Bruno | F41J 1/10 | 273/403 |
| D329,680 | S * | 9/1992 | Burn | D22/113 | |
| 5,169,157 | A * | 12/1992 | Salmon | F41J 1/10 | 242/160.1 |
| D373,169 | S * | 8/1996 | Kokko | D22/100 | |
| 5,577,733 | A * | 11/1996 | Downing | F41J 1/10 | 250/222.2 |
| 5,829,753 | A * | 11/1998 | Wiser | F41J 1/10 | 273/407 |
| D412,425 | S * | 8/1999 | Pai | D7/334 | |
| D565,824 | S * | 4/2008 | Mueller | D22/113 | |
| D635,814 | S * | 4/2011 | Leavens | D7/334 | |
| 8,141,878 | B2 | 3/2012 | Kuyl | | |
| 8,608,169 | B2 * | 12/2013 | Saunders | F41J 7/04 | 273/406 |
| D735,833 | S * | 8/2015 | Winstead | D22/113 | |
| 9,255,773 | B1 * | 2/2016 | Hall | F41J 1/10 | |
| 9,534,873 | B2 * | 1/2017 | Urban | F41J 1/10 | |
| 10,203,181 | B1 * | 2/2019 | Choi | F41J 5/10 | |
| D842,021 | S * | 3/2019 | Wenzel | D7/334 | |
| 10,267,602 | B2 * | 4/2019 | Carrillo Fuentevilla | F41J 3/0004 | |
| 10,274,291 | B2 * | 4/2019 | Davis | F41J 2/00 | |
| 10,371,316 | B2 * | 8/2019 | Barenbrugge | A63B 63/004 | |
| 10,584,826 | B2 | 3/2020 | Barenbrugge et al. | | |
| 10,610,010 | B2 | 4/2020 | Matlin et al. | | |
| D885,512 | S | 5/2020 | Hague et al. | | |
| 10,677,570 | B2 | 6/2020 | Hague et al. | | |
| D890,652 | S | 7/2020 | Nicoll et al. | | |
| 10,866,071 | B2 | 12/2020 | Huang | | |
| D910,799 | S | 2/2021 | Staats | | |
| D915,120 | S | 4/2021 | Bennion et al. | | |
| 2002/0125645 | A1 * | 9/2002 | Baker | F41J 1/10 | 273/407 |
| 2002/0158413 | A1 * | 10/2002 | Dehart | F41J 9/02 | 273/390 |
| 2007/0013138 | A1 * | 1/2007 | Hinnant | F41J 1/10 | 273/407 |
| 2008/0211190 | A1 * | 9/2008 | Smith | F41J 1/10 | 273/407 |
| 2009/0026708 | A1 * | 1/2009 | Sitton | F41J 3/0004 | 273/403 |
| 2011/0068538 | A1 * | 3/2011 | Kuyl | F41J 1/10 | 273/407 |
| 2011/0175293 | A1 * | 7/2011 | Brune | F41J 7/04 | 273/406 |
| 2011/0227288 | A1 * | 9/2011 | Krickovic | A63F 9/0204 | 273/348 |
| 2017/0059283 | A1 * | 3/2017 | Parrish | F41J 5/02 | |
| 2018/0202774 | A1 * | 7/2018 | Sitzman | F41J 5/24 | |
| 2019/0293391 | A1 * | 9/2019 | Hague | F41J 1/10 | |
| 2019/0360785 | A1 * | 11/2019 | Bitkowski | F41J 7/04 | |
| 2020/0363170 | A1 | 11/2020 | Cole | | |
| 2021/0033373 | A1 | 2/2021 | Babcock | | |
| 2021/0075366 | A1 | 3/2021 | West et al. | | |
| 2021/0102786 | A1 | 4/2021 | Howell et al. | | |

FOREIGN PATENT DOCUMENTS

| | | | |
|---|---|---|---|
| FR | 2540619 | A1 | 8/1984 |
| JP | 09229599 | A | 9/1997 |
| JP | 2015146948 | A | 8/2015 |
| WO | 9415166 | A1 | 12/1993 |
| WO | 2020085691 | A1 | 4/2020 |

OTHER PUBLICATIONS

U.S. Pat. No. 398,186; Rehfuss; issued Feb. 19, 1889.

Nicholas C. [GAOS 2018] American Range Systems Brought Out the Coffin, posted at the Firearm Blog, posting date Feb. 15, u 2018. Site visited Apr. 10, 2019. URL: <https ://www.thefirearmblog.com/blog/2018/02/15/american-range-sytems-coffin/> (Year: 2018).

Notice of Allowance for Design U.S. Appl. No. 29/641,337; United States Patent and Trademark Office; Alexandria, VA; dated Feb. 26, 2020.

Office Action for U.S. Appl. No. 29/732,522; United States Patent and Trademark Office Alexandria, VA; dated Jun. 10, 2021.

Champion 22 Rimfire Bullet Trap; Sportman's Warehouse, URL: <https://www.amazon.com/Thermaltake-Motherboard-Computer-Pre-lnstalled-CA-106-00 M6WN-OO/dp/B08451 HJ GG/ref=pd_rhf_dp_p_img_4? encoding=UTF8&psc=1 &refRI D=9VW1 R77E8T5K8E884JO>; (Year: 2017).

* cited by examiner

RUGGEDIZED HOLDER

CROSS REFERENCE TO RELATED APPLICATIONS

This application is a continuation of U.S. patent application Ser. No. 16/361,060, filed Mar. 21, 2019, entitled "RUGGEDIZED HOLDER", now allowed, which claims the benefit of U.S. Provisional Patent Application Ser. No. 62/646,065, filed Mar. 21, 2018, entitled "RUGGEDIZED HOLDER", the disclosures of which are hereby incorporated by reference.

BACKGROUND

Various aspects of the present disclosure relate generally to holders, and more specifically, to a ruggedized holder suitable for holding a roll of target media to be used in target shooting applications.

A target holder is a device that can be utilized to hold one or more targets, e.g., for firearm practice. The target holder is typically positioned a predetermined distance downrange from a shooter and provides a support structure upon which a target is positioned.

BRIEF SUMMARY

According to aspects of the present disclosure, a ruggedized holder is disclosed. The ruggedized holder has a base unit that accepts a roll of target media. The base unit includes a first side plate, and a second side plate that opposes the first side plate. Moreover, the base unit includes a lower deflector plate that extends between the first side plate and the second side plate. In this regard, the lower deflector plate has a front facing surface that extends inward and downward at an angle that is not vertical. The base unit still further includes an upper deflector plate that extends between the first side plate and the second side plate above the lower deflector plate, a deflection nose that couples the upper deflector plate to the lower deflector plate. The deflector nose has a curved shape that eliminates a vertical, flat surface outward facing to the ruggedized holder.

According to further aspects of the present disclosure, a ruggedized holder is disclosed. The ruggedized holder has a base unit that accepts a roll of target media. The base unit includes a first side plate, and a second side plate that opposes the first side plate. Moreover, the base unit includes a lower deflector plate that extends between the first side plate and the second side plate. In this regard, the lower deflector plate has a front facing surface that extends inward and downward at an angle that is not vertical. The base unit still further includes an upper deflector plate that extends between the first side plate and the second side plate above the lower deflector plate, a deflection nose that couples the upper deflector plate to the lower deflector plate. The deflector nose has a curved shape that eliminates a vertical, flat surface outward facing to the ruggedized holder. The ruggedized holder also includes a media cutting blade configured to provide a cutting surface to cut the roll of target media.

According to yet further aspects of the present disclosure, a ruggedized holder is disclosed. The ruggedized holder has a base unit that accepts a roll of target media. The base unit includes a first side plate, and a second side plate that opposes the first side plate. Moreover, the base unit includes a lower deflector plate that extends between the first side plate and the second side plate. In this regard, the lower deflector plate has a front facing surface that extends inward and downward at an angle that is not vertical. The base unit still further includes an upper deflector plate that extends between the first side plate and the second side plate above the lower deflector plate. Yet further, the ruggedized holder includes a decoupled rolling mechanism that is suspended above the base unit, wherein the decoupled rolling mechanism receives a free end of the roll of target media so as to form a web of target media that is front facing and spans between the decoupled rolling mechanism and the base unit.

DETAILED DESCRIPTION

A facility such as a firing range (also referred to as "shooting range"), provides an indoor environment where a shooter can discharge a firearm at a target. The target, which may be part of a target system, is positioned at one end of a shooting lane while the shooter stands at a firing line that is at an opposing end of the shooting lane. In some implementations, the target can be set to any one of varying distances from the firing line. A distance from the target to the firing line can vary depending upon the application, but a typical range is 5 meters to 30 meters for handguns, with some lanes extending to 100 meters and beyond for long guns.

As the shooter discharges the firearm at the target, projectiles (e.g., bullets or "rounds") are sent down range toward the target. In some cases, projectiles sent down range can miss the target and strike an element within firing range. For instance, projectiles can strike a piece of equipment that is a part of the target system, which causes damage to the equipment and typically necessitates repair of the equipment. Damage to equipment typically results in suspension of a shooting lane for at least one day, which may result in lost profit for shooting ranges, especially shooting ranges with limited shooting lane capacity.

Moreover, depending on material composition and relative angle of the struck element, the projectiles can deflect or ricochet back toward the firing line, and thus, the shooter.

Accordingly, aspects of the present disclosure are directed toward mitigating, or eliminating the issues described above by implementing a ruggedized holder as described in greater detail herein. In practical applications, the ruggedized holder includes surfaces that can withstand repeated strikes by projectiles without causing failure of the holder.

Moreover, the ruggedized holder is configured with forward facing surfaces that are oriented to induce ricochets away from the firing line (e.g., by directing stray projectiles that strike the ruggedized holder downrange of the firing line and in many circumstances, downrange of the shooting lane).

Ruggedized Holder

Figure 1:
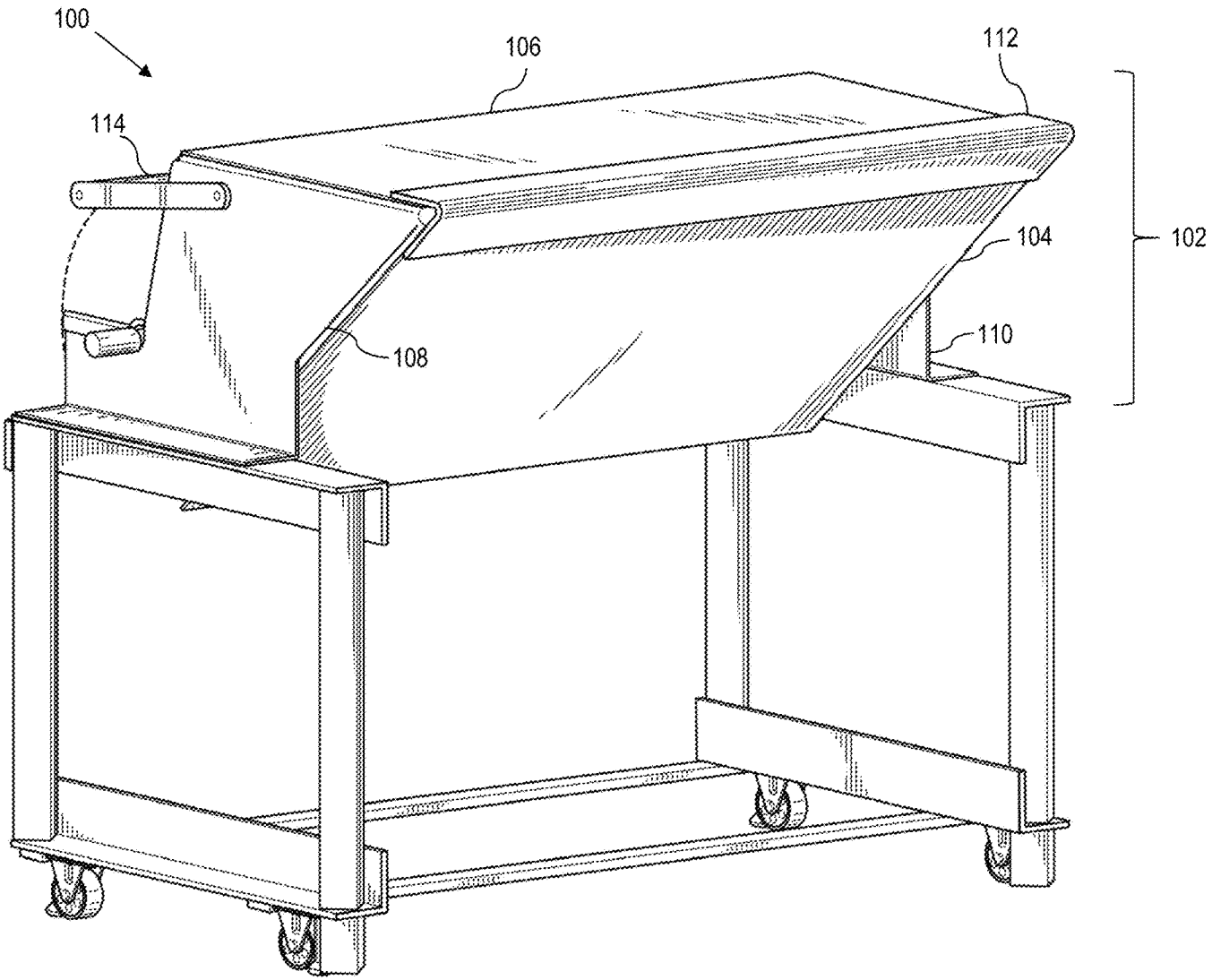
FIG. 1 is an isometric view of an embodiment of the ruggedized holder according to various aspects of the present disclosure.

Referring to drawings and in particular FIG. 1, a ruggedized holder 100 is illustrated according to aspects of the present disclosure herein. The ruggedized holder 100 comprises a base unit 102 that accepts a roll of target media (target media shown in dashed lines). Target media includes, but is not limited to pre-printed bullseye targets, picture targets, or blank media that a target is projected onto.

The base unit 102 comprises a lower deflector plate 104 having a front facing surface. Notably, the front facing surface of the lower deflector plate 104 is arranged at an angle so that there is not a flat surface facing a firing line (e.g., not perpendicular to a path of a projectile from the firing line). Instead, as illustrated, the lower deflector plate 104 has a generally downward angle so that a projectile that strikes the lower deflector plate 104 is redirected/ricochets downward and away from the firing line. The base unit 102 further comprises an upper deflector plate 106 as illustrated.

The base unit 102 also comprises a first side plate 108 and a second side plate 110 that opposes the first side plate 108. Spatially, the lower deflector plate 104 extends between the first side plate 108 and the second side plate 110. Correspondingly, the upper deflector plate 106 is above the lower deflector plate 104 and extends between the first side plate 108 and the second side plate 110. As such, the lower deflector plate 104, the upper deflector plate 106, the first side plate 108, and the second side plate 110, form a holder (or protector) for the roll of target media as described more fully herein.

Practically speaking, a location where the lower deflector plate 104 and the upper deflector plate 106 meet may be struck by bullets repeatedly over time. Thus, in various embodiments, a location where the lower deflector plate 104 and upper deflector plate 106 meet is covered (or otherwise reinforced) by a deflection nose 112. In some embodiments, the upper deflector plate 106 and the lower deflector plate 104 physically contact one another. In other embodiments, the deflection nose 112 can be used as a joining medium to physically couple the lower deflector plate 104 to the upper deflector plate 106, (e.g., using one or more screws, bolts, and/or other fasteners).

When in use, the deflection nose 112 will absorb impacts from projectiles with minimal damage to underlying plates (e.g., the lower deflection plate 104 and upper deflection plate 106). In addition, the deflection nose 112 prevents the projectile from penetrating the ruggedized holder 100 and striking the roll of target media behind the ruggedized holder 100. In various embodiments, the deflection nose 112 has a smoothed or curved geometry that avoids creating a flat, vertical surface parallel to the firing line, thereby reducing a likelihood that an errant projectile will deflect back toward the firing line and the shooter.

In multiple embodiments, the deflection nose 112 is replaceable through a variety of fastening tools and mechanisms such as rivets, bolts, slide channels, hook and loop, etcetera. Optionally, any exposed fasteners can (and should) be rounded at the top of the fastener, flush to the ruggedized holder 100, and/or recessed into the ruggedized holder 100 in order to reduce the possibility of projectile deflection. In this regard, analogous fasteners and equivalents can connect or couple together the various components of the ruggedized holder 100, which are described in greater detail herein.

In multiple embodiments, the base unit 102 further comprises a brake bar 114 having a first end and a second end. The brake bar 114 comprises an elongate bar that spans a horizontal distance between the first side plate 108 and the second side plate 110. In use, the brake bar 114 applies pressure to the roll of target media held by the base unit 102, thus reducing overtravel (e.g., inadvertent extra movement or spinning) by the roll of target media.

Figure 2:
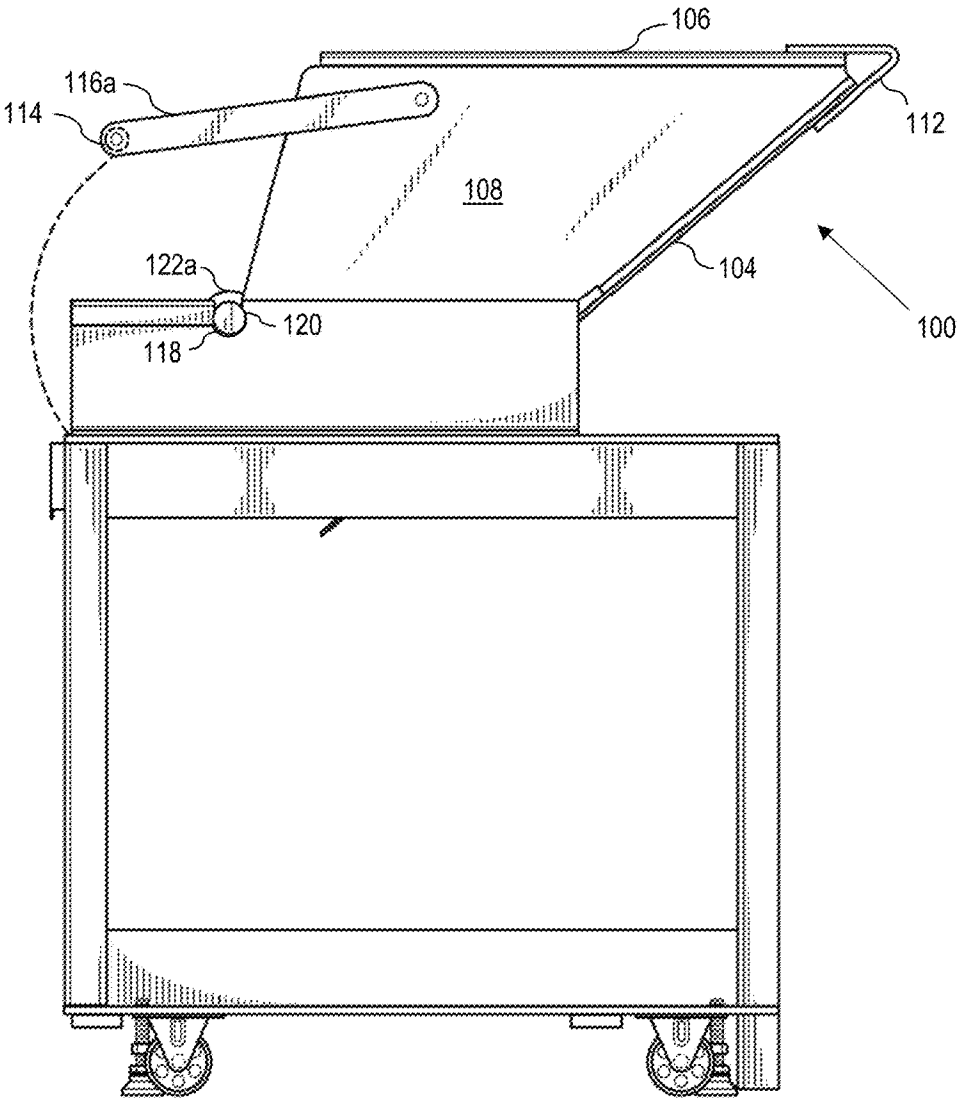
FIG. 2 is a right-side view of the embodiment of the ruggedized holder in FIG. 1, according to various aspects of the present disclosure.
Figure 3:
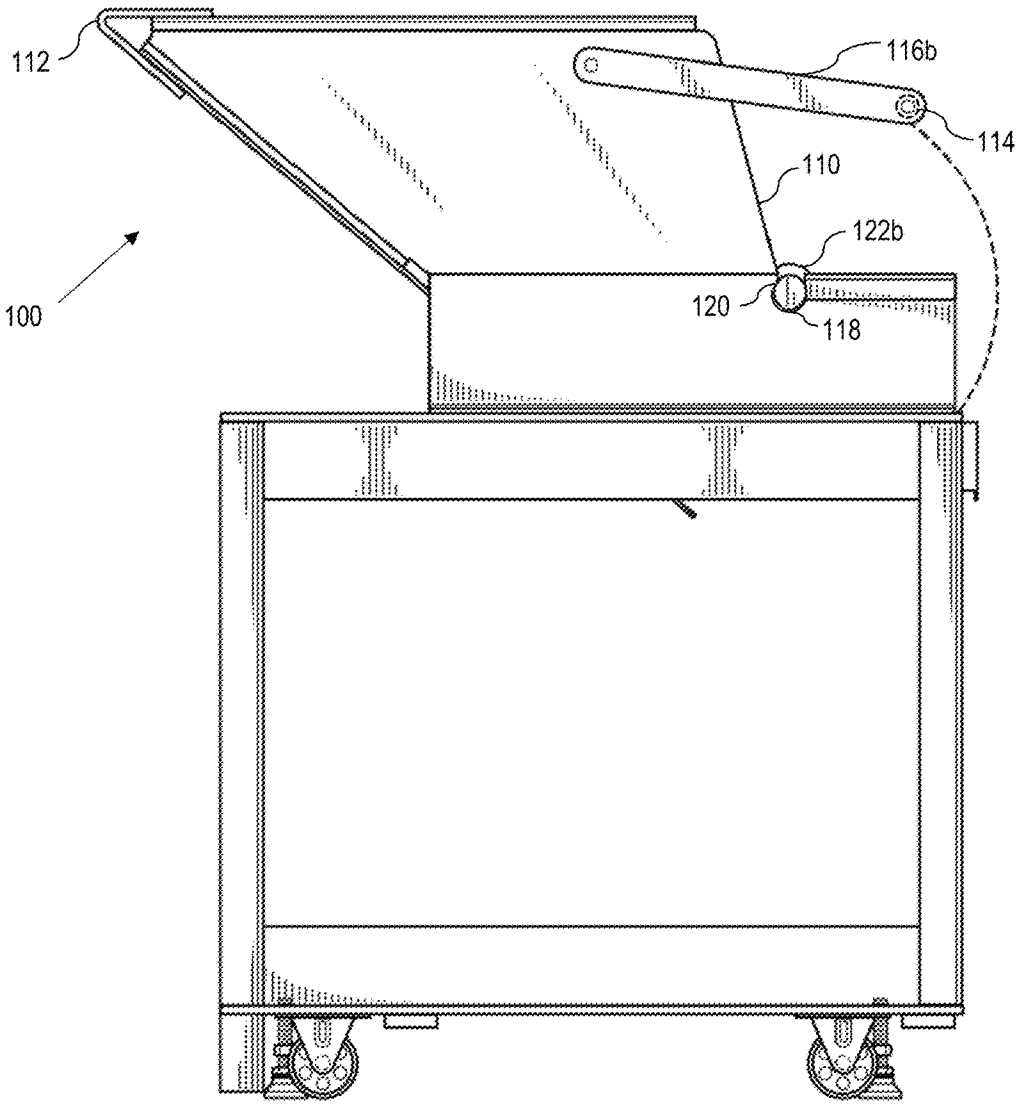
FIG. 3 is a left-side view of the embodiment of the ruggedized holder in FIG. 1, according to various aspects of the present disclosure.

Referring generally to FIGS. 2-3, the brake bar 114 (illustrated by a dashed circle) is disposed between a first brake bar bracket 116*a* that is coupled to the first side plate 108 (FIG. 2), and a second brake bar bracket 116*b* that is coupled the second side plate 110 (FIG. 3).

In various embodiments, the first side plate 108 and the second side plate 110 comprise channels 118 that receive an axle 120 that extends between the channels 118 on the first side plate 108 and the second side plate 110. The axle 120 supports the roll of target media. In some embodiments, one or more axle supports are implemented to prevent the roll of target media from shifting side to side and/or to provide a bearing surface for the roll of target media.

Here, a first axle support 122*a* (see FIG. 2) is disposed between the roll of target media and the first side plate 108, wherein the first axle support 122*a* prevents the roll of target media from shifting toward the first side plate 108. Correspondingly, a second axle support 122*b* (see FIG. 3) is disposed between the roll of target media and the second side plate 110, wherein the second axle support 122*b* prevents the roll of target media from shifting toward the second side plate 110.

Figure 4:
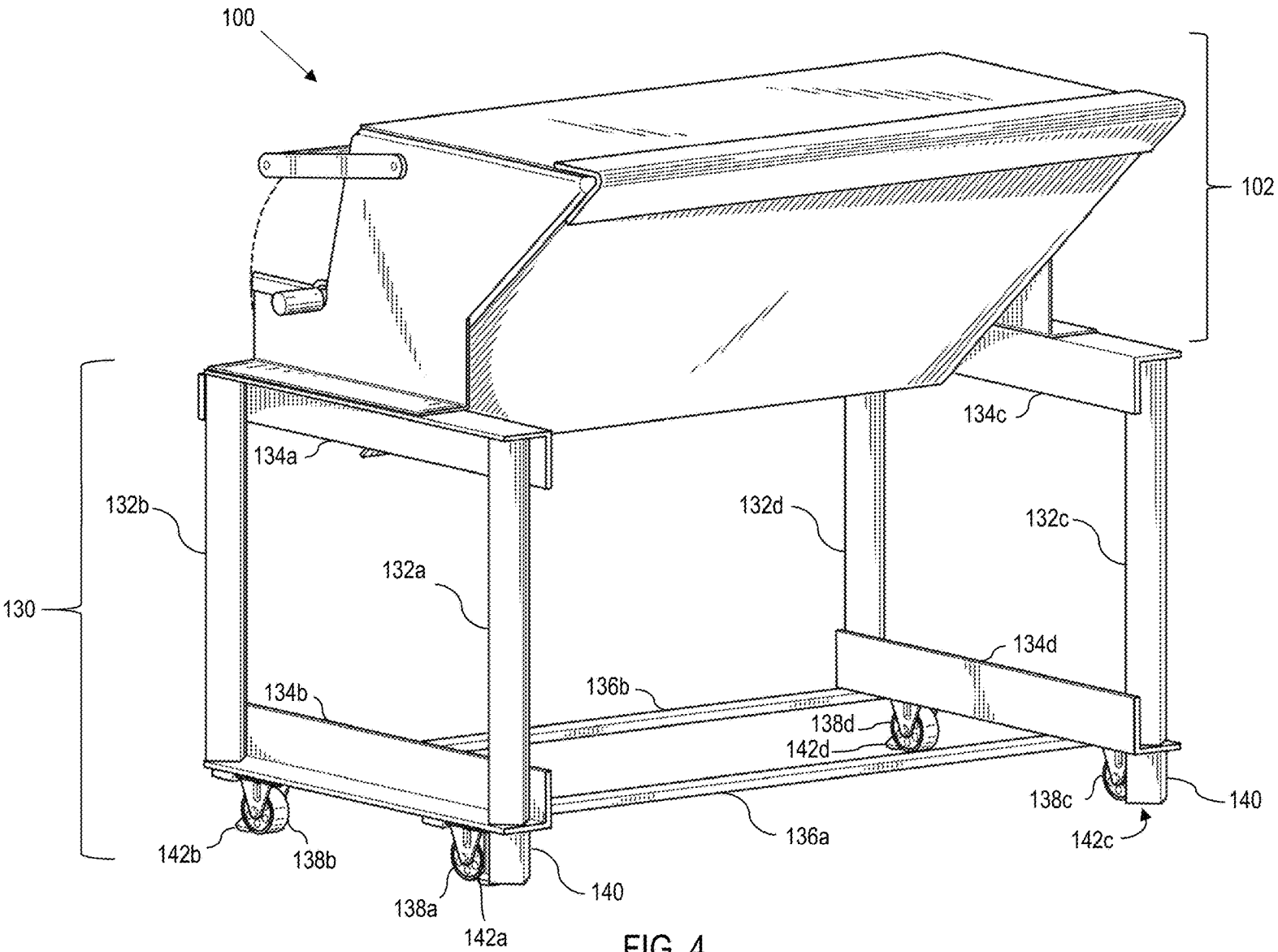
FIG. 4 is a perspective view of the embodiment of the ruggedized holder in FIG. 1, according to various aspects of the present disclosure.

Referring to FIG. 4, in various embodiments the ruggedized holder 100 further comprises a stand 130 that couples to the base unit 102. The stand 130 comprises at least one leg 132. For example, FIG. 4 illustrates an embodiment of the ruggedized holder 100 that comprises multiple legs (labeled 132*a*, 132*b*, 132*c*, and 132*d* respectively). In some embodiments, the legs 132*a*, 132*b*, 132*c*, and 132*d* are oriented in a vertical (or substantially vertical) orientation. In various embodiments, front-facing portions of the legs 132*a*, 132*b*, 132*c*, and 132*d* can be angled, curved, or otherwise dimensioned.

For example, one or more of the legs (e.g., front-side legs 132*a*, 132*c*) can have a "V" shape geometry, with a point of the V front-facing formed from two elongate, generally vertical surfaces that form a V-shape, where the point of the V forms a substantially vertical edge that is forward-facing. In other embodiments, a V-shaped guard can be positioned forward of one or more legs (e.g., forward of front-side legs 132*a*, 132*c*). The V-shape (either implemented as a leg or guard in front of a leg) provides a deflection surface so that a projectile that strikes the leg will ricochet away from the firing line, and thus, away from the shooter.

As illustrated in FIG. 4, the front facing surface of the lower deflector plate 104 is disposed at an angle that is not vertically parallel with the leg(s) (e.g., 132*a*, 132*b*, 132*c*, and 132*d* as shown), thus redirecting projectiles that strike the front facing surface of the lower deflector plate 104 toward the ground and away from the shooter. The front facing surface of the lower deflector plate 104 can be orientated at a desired angle, illustrative examples of which include 45 degrees, 50 degrees, 55 degrees, etc.

While the front facing surface of the lower deflector plate 104 is shown at a downward angle, embodiments where the front facing surface of the lower deflector plate 104 is at an upward angle is a possible configuration.

In various embodiments, the stand 130 further comprises one or more support members 134. As illustrated, there are four illustrated support members (labeled at 134*a*, 134*b*, 134*c*, and 134*d*). Each support member is disposed between an adjacent pair of legs 132. For example, support member 134*a* spans between legs 132*a* and 132*b*, support member 134*c* spans between legs 132*c* and 132*d*, etc., as shown in FIG. 4.

Moreover, in an example embodiment, support members 134 are illustrated as flanged or L-shaped brackets arranged in a horizontal, or generally horizontal orientation (front to back) to provide a support structure for the stand 130, and to provide a mounting surface to hold the base unit 102. However, any number of different configurations may be realized within the spirit of the present disclosure, to provide a suitable support structure for the base unit 102.

For instance, the support members 134*a*, 134*b*, 134*c*, and 134*d* can form a cross pattern while spanning from one leg to another leg, or support member 134*a* connects leg 132*a* to leg 132*c*, and so on. The base unit 102 may also be fastened to the support members as illustrated in FIG. 4 (e.g., the first side plate 108 fastened to support member 134*a*).

Further, additional support members (labeled 136*a* and 136*b*) can be optionally provided. For instance, as illustrated, the additional support members 136*a*, 136*b* extend laterally (orthogonal to the support members 134*a*, 134*b*, 134*c*, and 134*d*) from one side of the stand 130 to an opposite side of the stand 130. In practical implementations, the additional support members 136*a*, 136*b* can be implemented to further reinforce the ruggedized holder 100. However, such additional support members 136*a*, 136*b* are not strictly required.

In various embodiments, the stand 130 further comprises at least one wheel 138 positioned on a bottom surface of the stand 130. For example, as shown in FIG. 4, the stand 130 can be configured to have a wheel proximally located by each leg of the stand (labeled 138*a*, 138*b*, 138*c*, and 138*d* respectively). In various embodiments, the wheels 138 are casters (e.g., a rigid caster, a swivel caster, etc.).

Moreover, a shield 140 can be provided to prevent a projectile from striking the wheels 138. The shield 140 takes on a V-shaped configuration and orientation analogous to the V-shape defined above. Moreover, in some embodiments, the V-shape of the leg (or V-shaped guard in front of a leg) can extend downward in front of one or more wheels as shown in FIG. 4.

FIG. 4 illustrates an embodiment of the ruggedized holder 100 that has four wheels (labeled 138*a*, 138*b*, 138*c*, and 138*d*) positioned on a bottom surface of the stand 130. Here, a first forward positioned wheel (e.g., wheel 138*a*) and a second forward positioned wheel (e.g., wheel 138*c*) each have a shield 140 positioned in front of them (i.e., placed between the wheel and the shooter).

In various embodiments, the stand 130 comprises a leveling foot 142 positioned on the bottom surface of the stand 130 (e.g., either in lieu of, or in addition to, a wheel). In FIG. 4 the stand 130 has four leveling feet (labeled 142*a*, 142*b*, 142*c*, and 142*d*), each of which can be individually adjusted vertically to level or stabilize the stand 130. In various embodiments, the stand 130 comprises at least one wheel 138 and at least one leveling foot 142.

Figure 5:
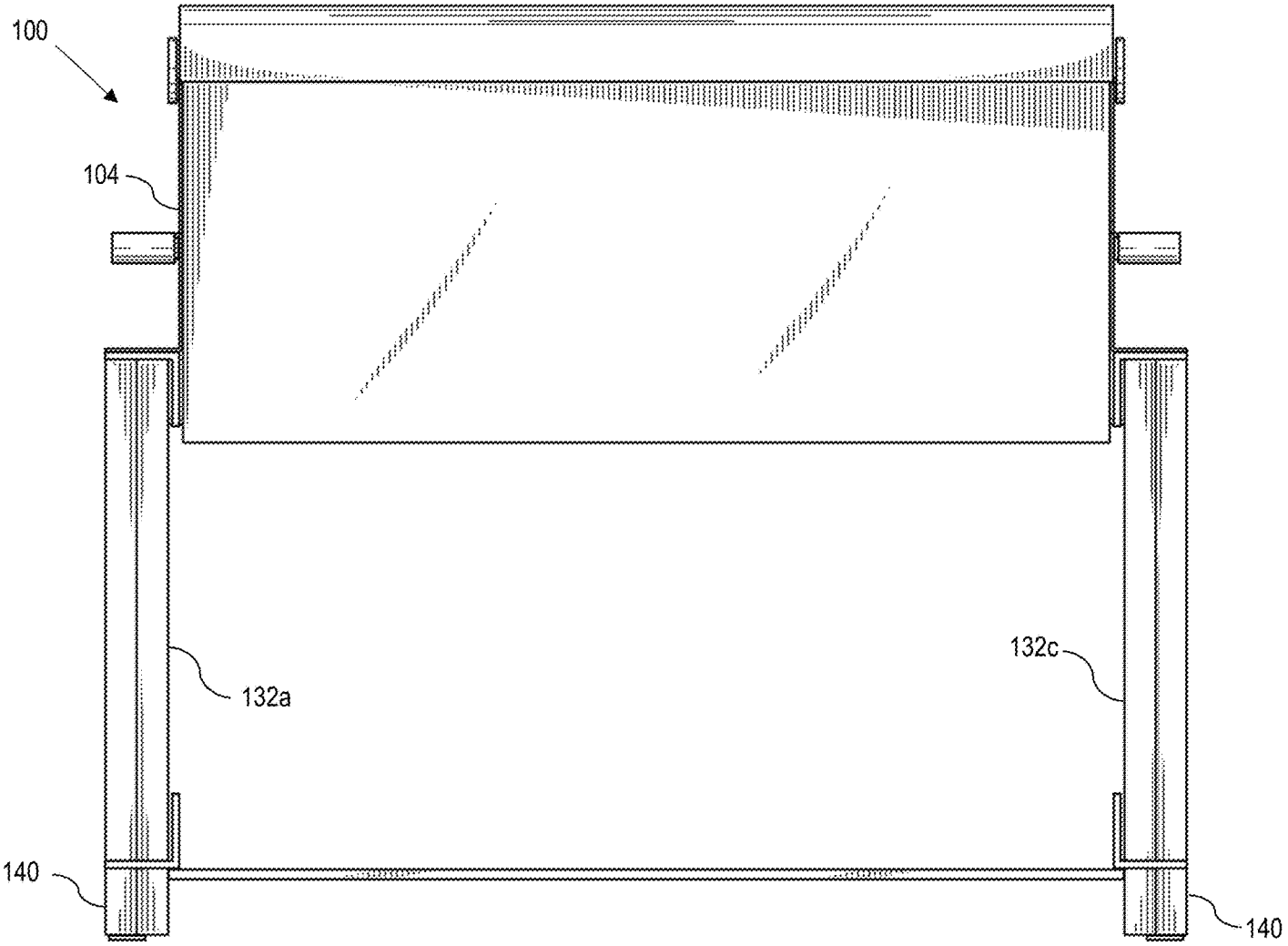
FIG. 5 is a front view of the embodiment of the ruggedized holder in FIG. 1, according to various aspects of the present disclosure.

Now referring to FIG. 5, a front view of the ruggedized holder 100 is illustrated. FIG. 5 illustrates the legs 132*a* and 132*c* with an edge defining the point of the V in the forward-facing direction (or guards in front of the legs in certain embodiments as disclosed herein) and corresponding shields 140 in front of the legs 132*a* and 132*c*.

Thus, if a projectile strikes a leg or shield, the projectile will ricochet down range, behind the shooting lane and will not ricochet back to the shooting lane. While shown as a V in FIG. 5, the legs 132*a* and 132*c*, guards, shields 140, etc., can be shaped as a semi-circle or any curved geometry that is not flat when front-facing. The reference number 104 for the lower deflector plate is shown for context.

Moreover, as illustrated in FIG. 5, rear-positioned wheels 138*b* and 138*d* don't necessarily need shields 140 if the stand 130 is oriented as to provide necessary protection from stray projectiles (e.g., rear-positioned wheels 138*b* and 138*d* are directly behind forward-positioned wheels 138*a* and 138*c* and/or shields 140).

Figure 6:
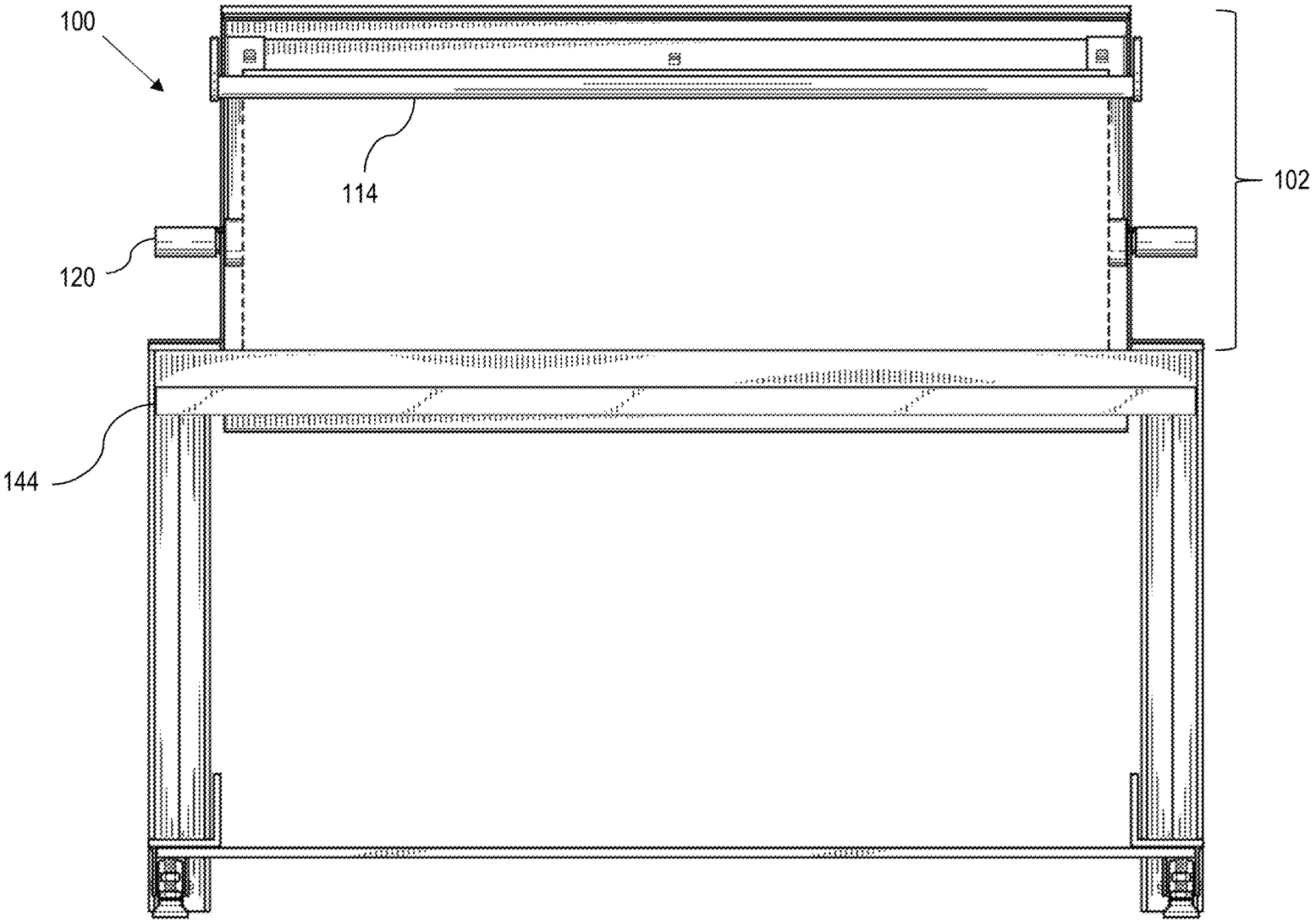
FIG. 6 is a rear view of the embodiment of the ruggedized holder in FIG. 1, according to various aspects of the present disclosure.

Now referring to FIG. 6, which is a rear view of the ruggedized holder 100, an example embodiment can further comprise a media cutting blade 144 coupled to the stand 130. In the illustrated embodiment, the media cutting blade 144 horizontally parallels the base unit 102 to provide a cutting surface to cut the roll of target media. The media cutting blade 144 allows an operator to take target media that has been fed from the roll of target media, and easily cut the target media off the roll.

Figure 7:
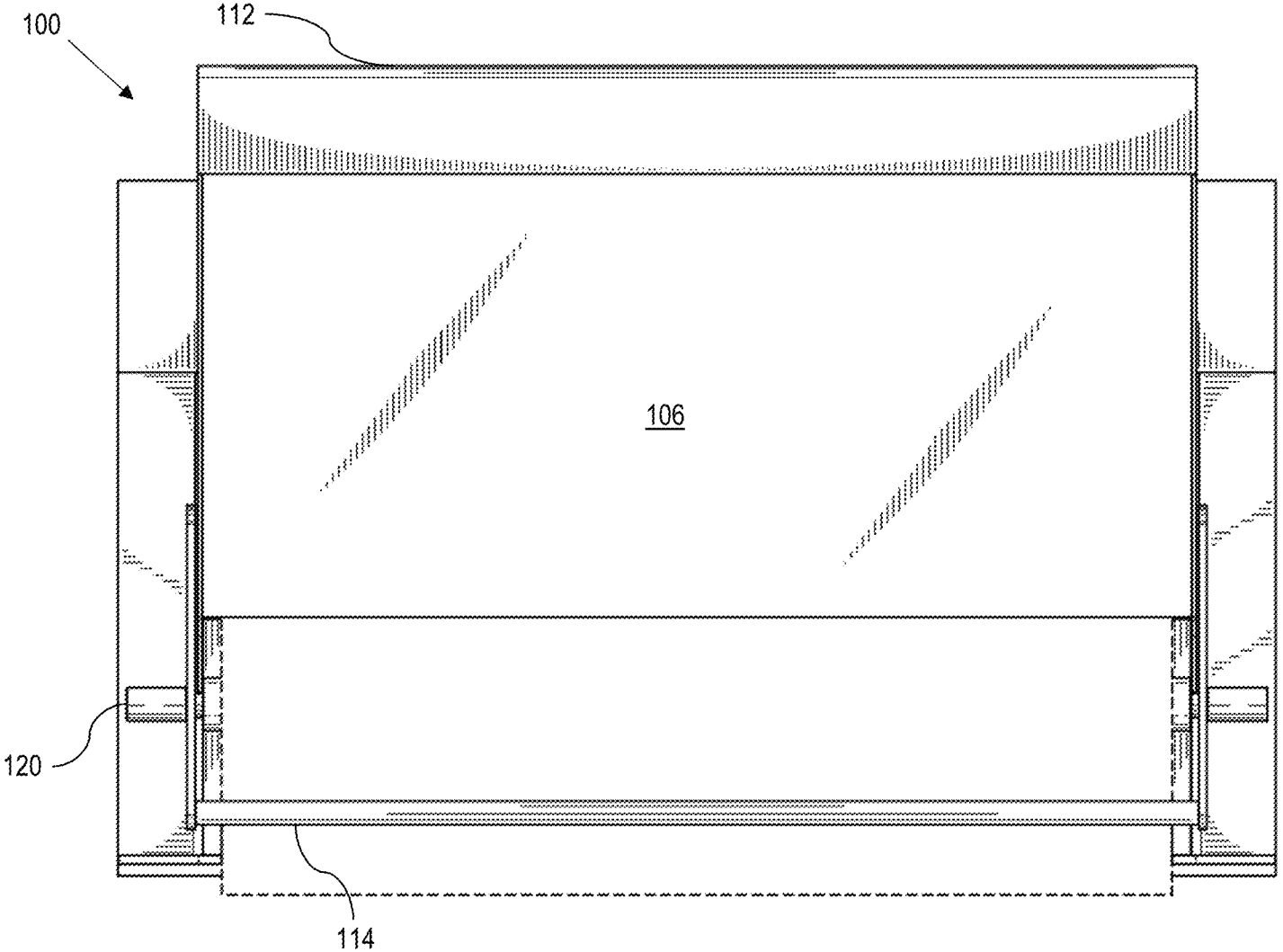
FIG. 7 is a top down view of the embodiment of the ruggedized holder in FIG. 1, according to various aspects of the present disclosure.
Figure 8:
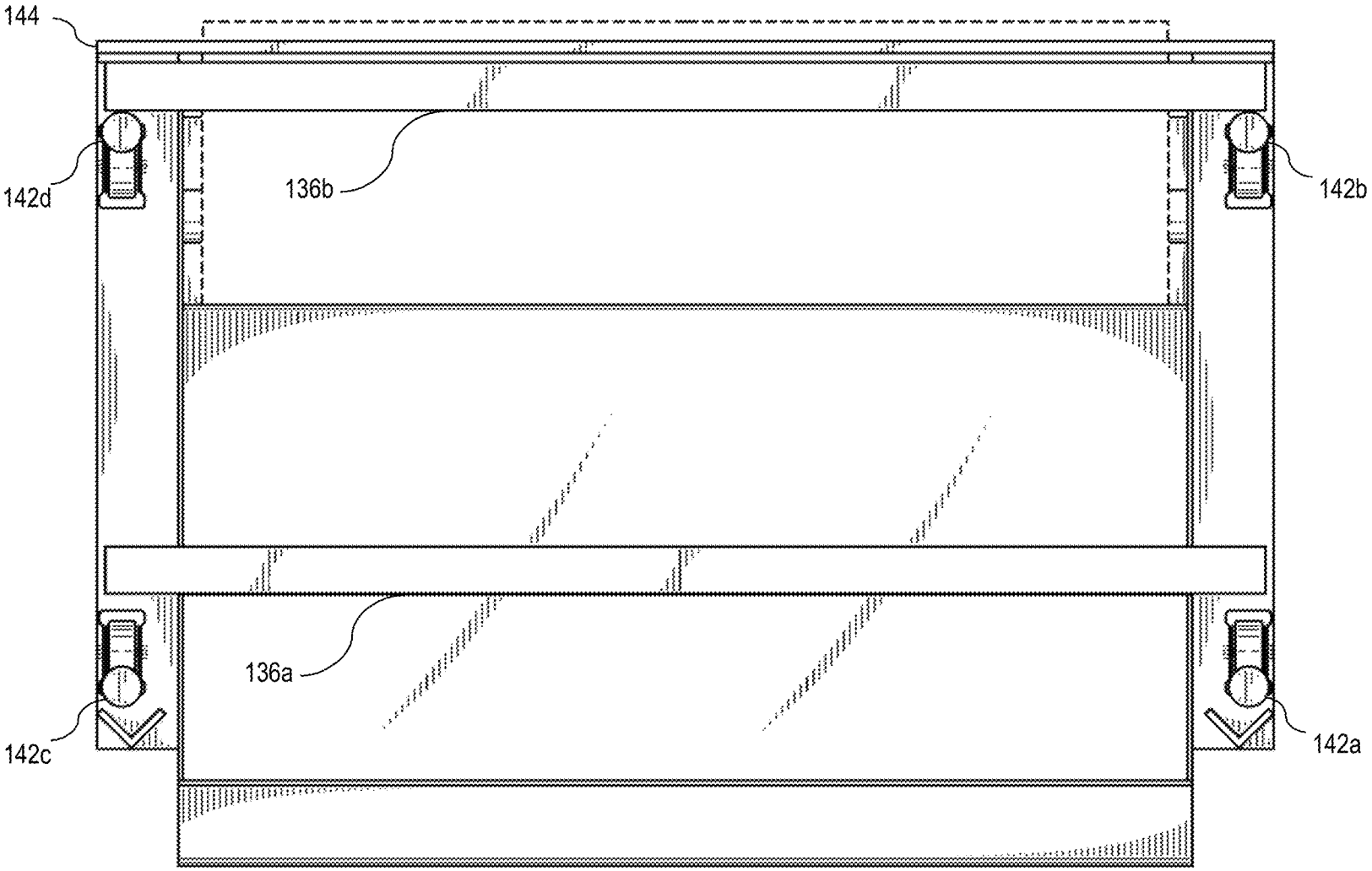
FIG. 8 is a bottom up view of the embodiment of the ruggedized holder in FIG. 1, according to various aspects of the present disclosure.

FIG. 7 and FIG. 8 illustrate a top down view and a bottom up view of the ruggedized holder 100 respectively.

An advantage the ruggedize holder 100 has over traditional targeting solutions is that every surface of the ruggedized holder 102 can be configured (or is configured) with a geometry that prevents a projectile ricochet from traveling back to the firing line. Instead, the projectile ricochet will typically travel downrange of the shooting lane. In particular, the downward angle of the lower deflector plate 104, and V-shaped shields/legs, redirect projectiles that strike the ruggedized holder 100 away from the roll of target media and downrange of the firing line. Thus, if a projectile misses a target, the projectile will not penetrate through the ruggedized holder 100 to the roll of target media.

Ruggedized Holder—Dual Roller Brake Mechanism

Figure 9:
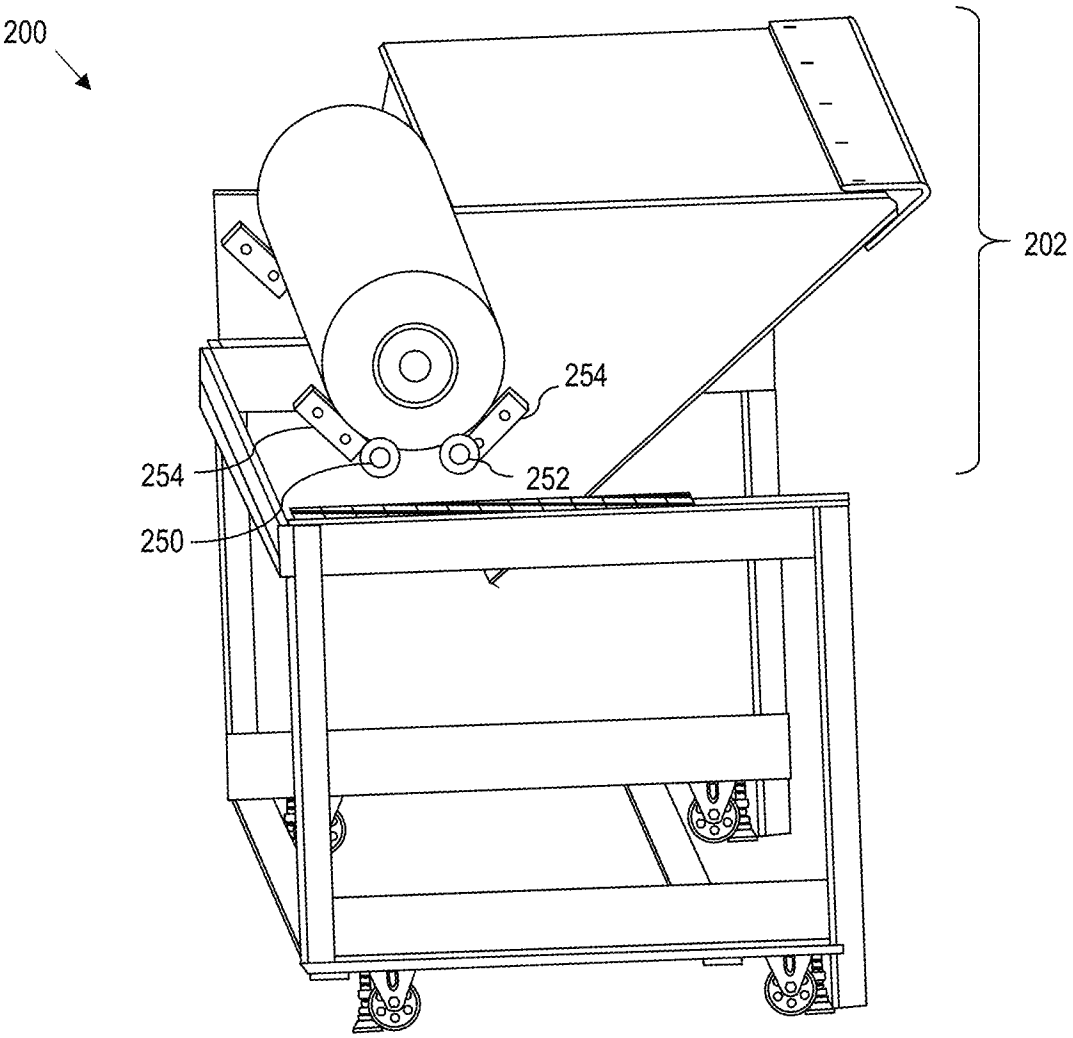
FIG. 9 is an isometric view of a ruggedized holder according to various aspects of the present disclosure.

FIG. 9 illustrates an alternate ruggedized holder 200 that utilizes a dual roller brake mechanism instead of a brake bar. Generally, the components of the ruggedized holder 200 are analogous to the ruggedized holder 100 unless stated otherwise. As a result, like components share like numbers, except that components of the ruggedized holder 200 are numbered 100 higher (e.g., the base 202 is analogous to the base 102). Moreover, embodiments and variations disclosed for the ruggedized holder 100 and ruggedized holder 200 may be used interchangeably.

The ruggedized holder 200 comprises a base unit 202. Analogously to the base unit 102 for the ruggedized holder 100, the base unit 202 for the ruggedized holder comprises a first side plate and a second side plate. The base unit 202 also comprises a lower deflector plate that extends between the first side plate and the second side plate, the lower deflector plate having a front facing surface. Moreover, the base unit 202 comprises an upper deflector plate that extends between the first side plate and the second side plate above the lower deflector plate. Further, the base unit 202 comprises a deflection nose that is disposed where the lower deflector plate and upper deflector plate meet.

Instead of supporting the roll of target media via an axle as described in reference to the ruggedized holder 100 (see reference number 120 in FIG. 1), the ruggedized holder 200 supports the roll of target media by using a brake mechanism comprising a first rolling bar 250 that supports a first portion of the roll of target media, and a second rolling bar 252 that supports a second portion of the roll of target media. In the illustrated embodiment, the second rolling bar 252 is parallel to the first rolling bar 250. In addition, a pair of brake blocks 254 surround the roll of target media in order to reduce overtravel by the roll of target media. The brake blocks 254 can serve as a friction surface against the roll of target media to reduce overtravel, or the brake blocks 254 can be configured to apply desired tension (e.g., electronic controls) against the roll of target media for enhanced control.

In various embodiments, the ruggedized holder 200 utilizes two pairs of brake blocks 254, where one pair of brake blocks are on a first end of the roll of target media, and the other pair of brake blocks are on a second end of the roll of target media.

In certain instances, rolling bars 250 and 252 are preferable over an axle in scenarios where the roll of target media is heavy, or the roll of target media is large in terms of length. A heavy and/or large roll of target media may cause an axle to bend, deform, or break, whereas rolling bars 250 and 252 can evenly distribute the roll of target media, thereby reducing load.

Figure 10:
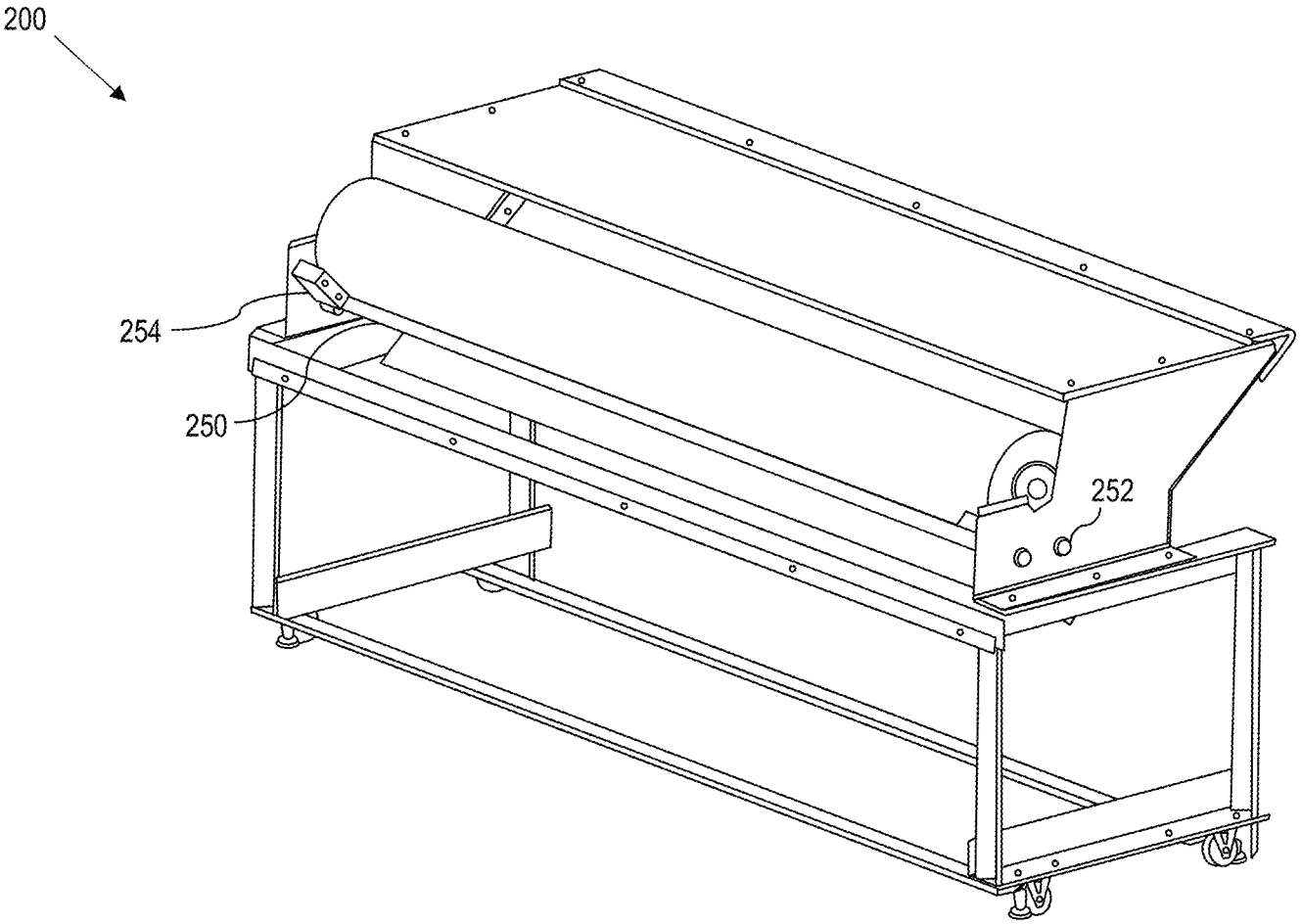
FIG. 10 is an isometric view of the ruggedized holder in FIG. 9, according to various aspects of the present disclosure.

FIG. 10 illustrates an embodiment of the ruggedized holder 200 accommodating a large roll of target media via the brake system as disclosed herein. As shown in FIG. 10, the ruggedized holder 200 can be scaled in various dimensions (e.g., length wise) to accommodate various lengths and sizes of target media.

Decoupled Rolling Mechanism

Figure 11:
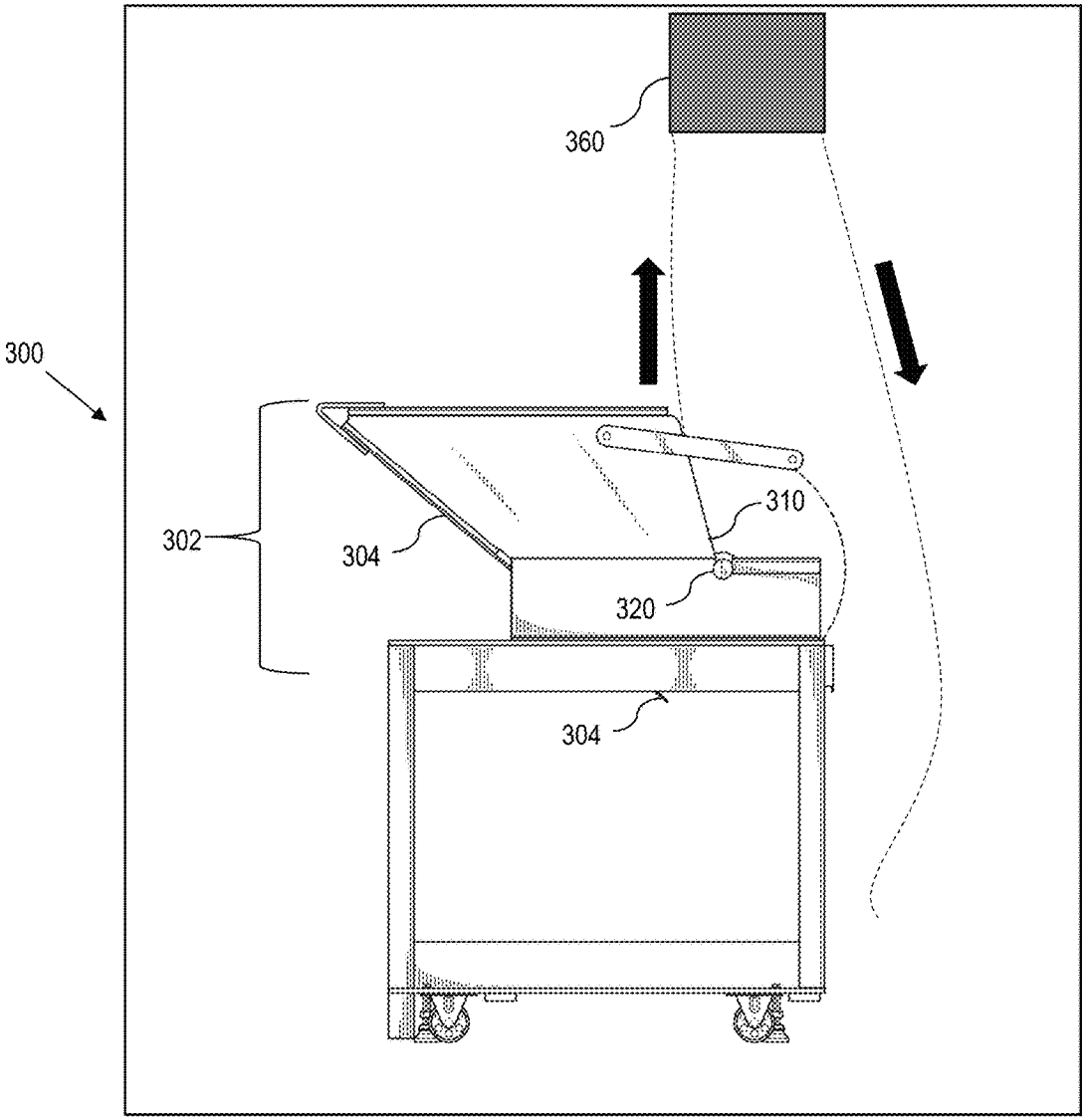
FIG. 11 is a left side view of a ruggedized holder according to various aspects of the present disclosure.

Now referring to FIG. 11, a ruggedized holder 300 is illustrated in use. Generally, the components of the ruggedized holder 300 are analogous to the ruggedized holder 100 unless stated otherwise. As a result, like components share like numbers, except that components of the ruggedized holder 300 are numbered 200 higher. Moreover, embodiments and variations disclosed for the ruggedized holder 100, ruggedized holder 200, and/or the ruggedized holder 300 may be used interchangeably.

The ruggedized holder 300 comprises a base unit 302. The base unit 302 comprises a first side plate, second side plate 310, a lower deflector plate 304 that extends between the first side plate and the second side plate 310, the lower deflector plate 304 having a front facing surface, and an upper deflector plate that extends between the first side plate and the second side plate 310 above the lower deflector plate 304, all of which have been described herein.

The front facing surface of the lower deflector plate 304 is disposed at an angle, thereby forming a ricochet surface that directs projectiles away from the roll of target media. As illustrated, in various embodiments the lower deflector plate 304 is dimensioned to exceed a dimension of the roll of target media so that projectiles fired at the base unit 302 will not strike the roll of target media or other components of the ruggedized holder 300 that are behind the lower deflector plate 304.

In addition, the ruggedized holder 300 comprises a decoupled rolling mechanism 360 that is suspended above the base unit 302. The decoupled rolling mechanism 360 receives a free end of the roll of target media that forms a web of target media that is front facing and spans between the decoupled rolling mechanism 360 and the base unit 302. An example path of the free end of the roll of target media through the decoupled rolling mechanism 360 is illustrated by directional arrows.

An advantage of the ruggedized holder 300 is the lack of a frame or structure between the decoupled rolling mechanism 360 and the base unit 302. Due to the nature of target shooting, frames and structure that are in a shooting lane are vulnerable to damage from projectiles. Such damage may lead to repair and/or replacement of the frame. In addition to costs associated with repair and replacement of the frame, owners of the shooting lane are likely to incur financial losses due to shutting down the shooting range during repair/replacement. Conversely, under the present disclosure, such repairs, replacements, and shut downs due to frame damage are practically nonexistent given the lack of a frame.

In various embodiments, the upper deflector plate is positioned as to allow a web of the roll of target media to pass there behind to the decoupled rolling mechanism 360, thereby defining a target area. For example, each of the first side plate (obscured by view) and second side plate 310 may utilize a generally "L" shaped surface so as to expose at least a portion of the roll of target media downrange of the lower deflector plate 304, and a surface that extends from the "L" shaped surface at an upward angle up range relative to the axle 320.

Moreover, in multiple embodiments, a horizontal portion of the "L" shaped surface can be deflected outward so that a user loading the roll of target media does not have to engage a sharp surface. In addition, the outward deflection can also facilitate loading in the roll of target media. The outward defection is also illustrated in FIG. 10, near reference number 252.

Miscellaneous

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step-plus-function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Aspects of the disclosure were chosen and described in order to best explain the principles of the disclosure and the practical application, and to enable others of ordinary skill in the art to understand the disclosure for various embodiments with various modifications as are suited to the particular use contemplated.

What is claimed is:

1. A ruggedized holder comprising:

a base unit that accepts a roll of target media, the base unit comprising:

a first side plate;

a second side plate that opposes the first side plate;

a lower deflector plate that extends between the first side plate and the second side plate, the lower deflector plate having a front facing surface that extends inward and downward at an angle that is not vertical;

an upper deflector plate that extends between the first side plate and the second side plate above the lower deflector plate; and a deflection nose that couples the upper deflector plate to the lower deflector plate, the deflector nose having a curved shape that eliminates a vertical, flat surface outward facing to the ruggedized holder.

2. The ruggedized holder of claim 1 further comprising:

a decoupled rolling mechanism that is suspended above the base unit, wherein the decoupled rolling mechanism receives a free end of the roll of target media so as to form a web of target media that is front facing and spans between the decoupled rolling mechanism and the base unit.

3. The ruggedized holder of claim 1 further comprising:

a brake bar having a first end and a second end, comprising:

an elongate bar that spans a horizontal distance between the first side plate and the second side plate that applies pressure to the roll of target media held by the base unit;

a first brake bar bracket coupled to the first end of the bar, wherein the first brake bar bracket is coupled to the first side plate; and a second brake bar bracket coupled to the second end of the bar, wherein the second brake bar bracket is coupled to the second side plate.

4. The ruggedized holder of claim 1, wherein:

the roll of target media is supported on an axle that extends between the first side plate and the second side plate.

5. The ruggedized holder of claim 4 further comprising:

a first axle support disposed between the roll of target media and the first side plate, wherein the first axle support prevents the roll of target media from shifting toward the first side plate; and a second axle support disposed between the roll of target media and the second side plate, wherein the second axle support prevents the roll of target media from shifting toward the second side plate.

6. The ruggedized holder of claim 1 further comprising:

a brake mechanism that supports the roll of target media, the brake mechanism comprising a first rolling bar that supports a first portion of the roll of target media, and a second rolling bar that supports a second portion of the roll of target media.

7. The ruggedized holder of claim 6, wherein the brake mechanism further comprises:

at least one brake block about the roll of target media that serves as a friction surface against the roll of target media to reduce overtravel by the roll of target media.

8. The ruggedized holder of claim 7, wherein the at least one brake block is electronically controlled to apply a desired tension to the roll of target media.

9. The ruggedized holder of claim 1 further comprising:

a media cutting blade coupled to the stand, wherein the media cutting blade horizontally parallels the base unit so as to provide a cutting surface to cut the roll of target media.

10. The ruggedized holder of claim 1, wherein:

the deflection nose detachably connects to both the lower deflector plate and the upper deflector plate.

11. The ruggedized holder of claim 1 further comprising:

a stand that couples to the base unit, the stand comprising a leg having a "V" shape geometry, with a point of the V front facing.

12. A ruggedized holder comprising:

a base unit that accepts a roll of target media, the base unit comprising:

a first side plate;

a second side plate;

a lower deflector plate that extends between the first side plate and the second side plate, the lower deflector plate having a front facing surface that extends inward and downward at an angle that is not vertical, thereby forming a ricochet surface that directs projectiles away from the roll of target media;

an upper deflector plate that extends between the first side plate and the second side plate above the lower deflector plate;

a deflection nose that couples the upper deflector plate to the lower deflector plate, the deflector nose having a curved shape that eliminates a vertical, flat surface outward facing to the ruggedized holder; and a media cutting blade configured to provide a cutting surface to cut the roll of target media.

13. The ruggedized holder of claim 12 further comprising:

a decoupled rolling mechanism that is suspended above the base unit, wherein the decoupled rolling mechanism receives a free end of the roll of target media so as to form a web of target media that is front facing and spans between the decoupled rolling mechanism and the base unit.

14. The ruggedized holder of claim 12 further comprising:

a brake mechanism that supports the roll of target media, comprising:

a first rolling bar that supports a first portion of the roll of target media;

a second rolling bar that supports a second portion of the roll of target media, wherein the second rolling bar is parallel to the first rolling bar; and a pair of brake blocks that reduce overtravel by the roll of target media.

15. The ruggedized holder of claim 12 further comprising:

a stand that couples to the base unit, the stand comprising a leg having a "V" shape geometry, with a point of the V front facing.

16. A ruggedized holder comprising:

a base unit that accepts a roll of target media, the base unit comprising:

a first side plate;

a second side plate that opposes the first side plate;

a lower deflector plate that extends between the first side plate and the second side plate, the lower deflector plate having a front facing surface that extends inward and downward at an angle that is not vertical; and an upper deflector plate that extends between the first side plate and the second side plate above the lower deflector plate; and a decoupled rolling mechanism that is suspended above the base unit, wherein the decoupled rolling mechanism receives a free end of the roll of target media so as to form a web of target media that is front facing and spans between the decoupled rolling mechanism and the base unit.

17. The ruggedized holder of claim 16, wherein:

the upper deflector plate is configured to allow a web of the roll of target media to pass upward to the decoupled rolling mechanism, thereby defining a target area between the base unit and the decoupled rolling mechanism.

18. The ruggedized holder of claim 16, wherein:

the lower deflector plate is dimensioned to exceed a dimension of the roll of target media so that projectiles fired at the base unit will not strike the roll of target media.

19. The ruggedized holder of claim 16, wherein:

each of the first side plate and second side plate have a generally "L" shaped surface so as to expose at least a portion of the roll of target media downrange of the lower deflector plate, and a surface that extends from the "L" shaped surface at an upward angle uprange.

20. The ruggedized holder of claim 16 further comprising:

a first target axle support disposed between the roll of target media and the first side plate, wherein the first target axle support prevents the roll of target media from shifting toward the first side plate; and a second target axle support disposed between the roll of target media and the second side plate, wherein the second target axle support prevents the roll of target media from shifting toward the second side plate.

* * * * *